US005645036A

United States Patent [19]

Matsumoto et al.

[11] Patent Number: 5,645,036

[45] Date of Patent: Jul. 8, 1997

[54] FUEL VAPOR CAPTURING CANISTER HAVING INCREASED DISTANCE OF FLOW OF FUEL VAPOR PASSING THROUGH ADSORBENT LAYER

[75] Inventors: Hideki Matsumoto; Naritoshi Muramatsu; Hiroaki Mihara, all of Wako; Masahiko Uchiyama, Hamakita; Kouichi Ikuma, Hamakita; Takenori Suzuki, Hamakita, all of Japan

[73] Assignees: Honda Giken Kogyo Kabushiki Kaisha, Tokyo; Toyo Roki Seizo Kabushiki Kaisha, Hamakita, both of Japan

[21] Appl. No.: 541,797

[22] Filed: Oct. 10, 1995

[30] Foreign Application Priority Data

Oct. 18, 1994 [JP] Japan ..... 6-279953

[51] Int. Cl.[6] ..... F02M 37/04

[52] U.S. Cl. ..... 123/519; 123/516

[58] Field of Search ..... 123/520, 521, 123/519, 518, 516; 55/387

[56] References Cited

U.S. PATENT DOCUMENTS

| | | | |
|---|---|---|---|
| 4,306,894 | 12/1981 | Fukami | 123/519 |
| 4,877,001 | 10/1989 | Kenealy | 123/520 |
| 5,304,235 | 4/1994 | Watanabe | 123/519 |
| 5,398,660 | 3/1995 | Koyama | 123/520 |
| 5,408,977 | 4/1995 | Cotton | 123/520 |
| 5,450,833 | 9/1995 | Denz | 123/520 |

FOREIGN PATENT DOCUMENTS

| | | |
|---|---|---|
| 50-22921 | 3/1975 | Japan . |
| 53-51506 | 5/1978 | Japan . |
| 7-139442 | 5/1995 | Japan . |
| 7-139441 | 5/1995 | Japan . |

*Primary Examiner*—Carl S. Miller

*Attorney, Agent, or Firm*—Armstrong, Westerman, Hattori, McLeland & Naughton

[57] ABSTRACT

A fuel vapor capturing canister includes a cylindrical casing having a communicating hole which is formed at one end so as to communicate with the atmosphere and another communicating hole which is formed at the other end so as to communicate with a fuel tank and an intake system of an engine. An adsorbent is accommodated in the casing so as to form at least one layer. A pair of partitioning plates partition the adsorbent layer longitudinally of the casing. A deflecting plate is disposed between the partitioning plates so as to protrude from an inner wall face of the casing inwardly of the same. The partitioning plates are open in the vicinity of sides of the deflecting plate respectively.

5 Claims, 8 Drawing Sheets

FUEL VAPOR CAPTURING CANISTER HAVING INCREASED DISTANCE OF FLOW OF FUEL VAPOR PASSING THROUGH ADSORBENT LAYER

BACKGROUND OF THE INVENTION

1. Field of the Invention

This invention relates to a fuel vapor capturing canister for capturing fuel vapor produced in a fuel system of an engine by means of an adsorbent layer to prevent dissipation of the fuel vapor into the atmosphere.

2. Description of the Prior Art

Japanese Unexamined Patent Application Publication No. 50-22921 (1975) discloses a conventional canister of the above-described type. Referring to FIG. 10, a sectional view of the disclosed canister is shown. A cylindrical casing 1 is made of an impermeable material and accommodates an activated carbon layer 2 therein. One of two surfaces of the activated carbon layer 2 communicates with the atmosphere through an opening 3*a* of a retainer 3. The other surface of the activated carbon layer 2 communicates both with a fuel tank 4 and with an intake pipe 5 through separate openings 1*a* and 1*b*, respectively. The activated carbon layer 2 is divided into two layers 2*a* and 2*b* axially of the casing 1 by an elastic member 6 comprised of a plate-shaped permeable member.

In the above-described construction, fuel vapor produced in the fuel tank 4 enters the upper activated carbon layer 2*a* through the opening 1*a*. Passing through the permeable elastic member 6, the fuel vapor then enters the lower activated carbon layer 2*b*. The fuel component is thus captured by the activated carbon as the fuel vapor passes through its layer. On the other hand, upon start of an engine, a negative pressure is supplied to the opening 1*b* communicating with the intake pipe 5. Consequently, air is drawn through the lower activated carbon layer 2*b*, the elastic member 6 and the upper activated carbon layer 2*a* sequentially, whereupon the fuel component captured by the activated carbon is purged therefrom to be supplied through the intake pipe 5 to the engine.

In the above-described canister, the fuel vapor is adsorbed by, and purged from the, activated carbon as the air containing it flows axially of the casing 1. Accordingly, the distance that the air containing the fuel vapor passes through the activated carbon layer 2 depends upon the length of the casing 1. The fuel vapor capturing efficiency is lowered as the casing 1 becomes shorter. Thus, the above-described canister poses a problem of the fuel vapor capturing efficiency.

Furthermore, the prior art has proposed another construction in which the air containing the fuel vapor is caused to reciprocally flow along complicate flow paths in the casing 1. However, only part of the activated carbon serves to capture the fuel vapor in each flow path, and accordingly, an entire activated carbon accommodated in the casing 1 cannot be used efficiently.

SUMMARY OF THE INVENTION

Therefore, an object of the present invention is to provide a fuel vapor capturing canister which can improve the fuel vapor capturing performance without rendering the casing large-sized.

To achieve the object, the present invention provides a fuel vapor capturing canister comprising a casing formed into the shape of a cylinder and having a communicating hole which is formed at one end thereof so as to communicate with the atmosphere and another communicating hole which is formed at the other end thereof so as to communicate with both a fuel storage system and an intake system of an engine. An adsorbent material is accommodated in the casing so as to form at least one layer. A pair of partitions are provided for partitioning the adsorbent layer longitudinally of the casing. A deflecting plate is disposed between the partitions so as to protrude from an inner wall face of the casing inwardly of the same, the partitions being open in the vicinity of opposite sides of the deflecting plate, respectively.

According to the above-described construction, the fuel vapor which has entered an adsorbent layer defined between the partitions flows longitudinally of the casing, bypassing the deflecting plate and turning circumferentially of the casing. Thus, the fuel vapor flows between the communicating holes. Furthermore, when the fuel vapor flows along the above-mentioned flow path, a part thereof strikes against the deflecting plate to be thereby repelled, whereupon the fuel vapor is diffused in the adsorbent layer. Accordingly, the fuel vapor passes through the adsorbent layer along a relatively long flow path, bypassing the deflecting plate. Furthermore, since the fuel vapor is diffused when bypassing the deflecting plate, the fuel vapor is brought into contact with a larger amount of adsorbent. Consequently, the fuel vapor capturing efficiency can be improved. Additionally, since part of the fuel vapor is repelled against the deflecting plate to be thereby diffused in the adsorbent layer. Consequently, the adsorbent can be efficiently used.

Another object of the invention is to provide a fuel vapor capturing canister which can use the adsorbent more efficiently.

To achieve the object, the canister further comprises an auxiliary deflecting plate which is disposed in the casing so as to abut against the adsorbent layer at one side thereof and so as to be connected to the deflecting plate. The auxiliary deflecting plate protrudes from one of the partitions toward the other partition.

The air and fuel vapor bypass the auxiliary deflecting plate in the middle of the flow path so as to turn back longitudinally of the casing. Thus, the flow path of the air and fuel vapor is extended circuitously. Furthermore, when the fuel vapor flows along the above flow path, a part of the fuel vapor strikes against the deflecting plate and the auxiliary deflecting plate, so that the fuel vapor is diffused in the adsorbent layer. Thus, since the long flow path provided by the deflecting plate can be rendered longer by the auxiliary deflecting plate, the fuel vapor can be brought into contact with a larger amount of adsorbent. Consequently, the fuel vapor capturing efficiency can be improved to a large extent. Furthermore, a part of the fuel vapor strikes against the deflecting plate and the auxiliary deflecting plate such that the fuel vapor is diffused in the adsorbent layer. Consequently, the adsorbent can be used efficiently.

Yet another object of the invention is to provide a fuel vapor capturing canister in which the fuel vapor adsorbing efficiency can be readily regulated.

To achieve the object, the invention provides a fuel vapor capturing canister wherein an adsorbent layer defined between the partitions is a part of the adsorbent accommodated in the casing.

The fuel vapor bypasses the deflecting plate in the adsorbent layer defined between the partitions, whereas the fuel vapor flows in the other part of the adsorbent layer without bypassing the deflecting plate. Changing the width of the adsorbent layer can regulate an amount of fuel vapor bypassing the deflecting plate and turning circumferentially of the casing. An extent of turn of the fuel vapor is increased when the fuel vapor adsorbing efficiency is desired to be increased, whereas the extent of turn is decreased when the fuel vapor adsorbing efficiency need not be increased. Thus, the fuel vapor adsorbing efficiency can be regulated by changing the extent of turn of the fuel vapor bypassing the deflecting plate under the condition of the same amount of adsorbent.

Still another object of the invention is to further improve the fuel vapor diffusing efficiency.

To achieve the object, the invention provides a fuel vapor capturing canister wherein the partitions comprise two plate members juxtaposed so that a space is defined therebetween, and the plate members are formed with respective openings so that positions of the openings are shifted with respect to each other.

The fuel vapor passes through the space defined between the plate members before entering the adsorbent layer between the partitions. Since the entrance and exit openings of the respective plate members are shifted with respect to each other, the fuel vapor is sufficiently diffused in the space and then enters the adsorbent layer. Consequently, the diffusion of the fuel vapor can be further enhanced.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
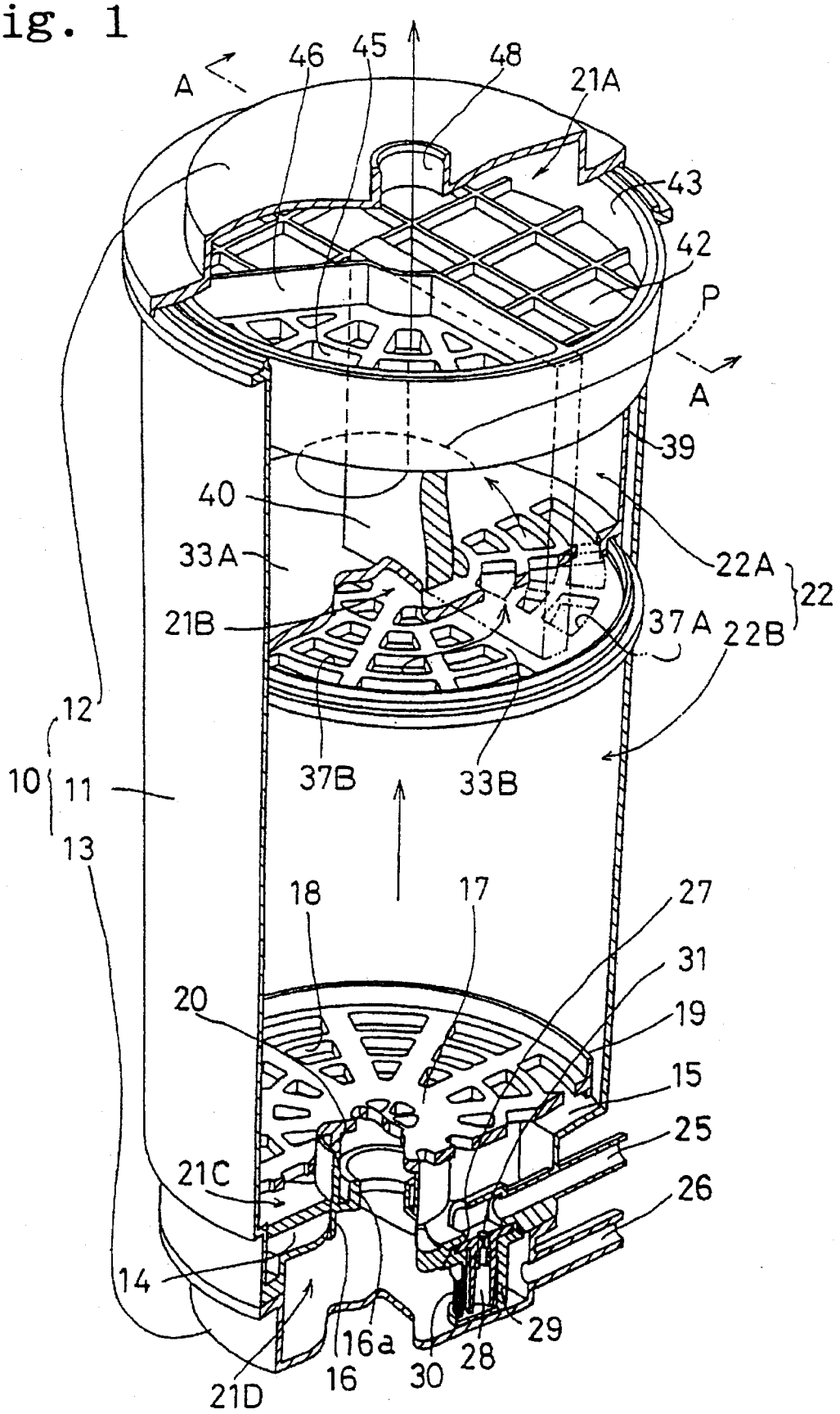
FIG. 1 is a sectioned perspective view of a fuel vapor canister in accordance with a first embodiment of the present invention.
Figure 2:
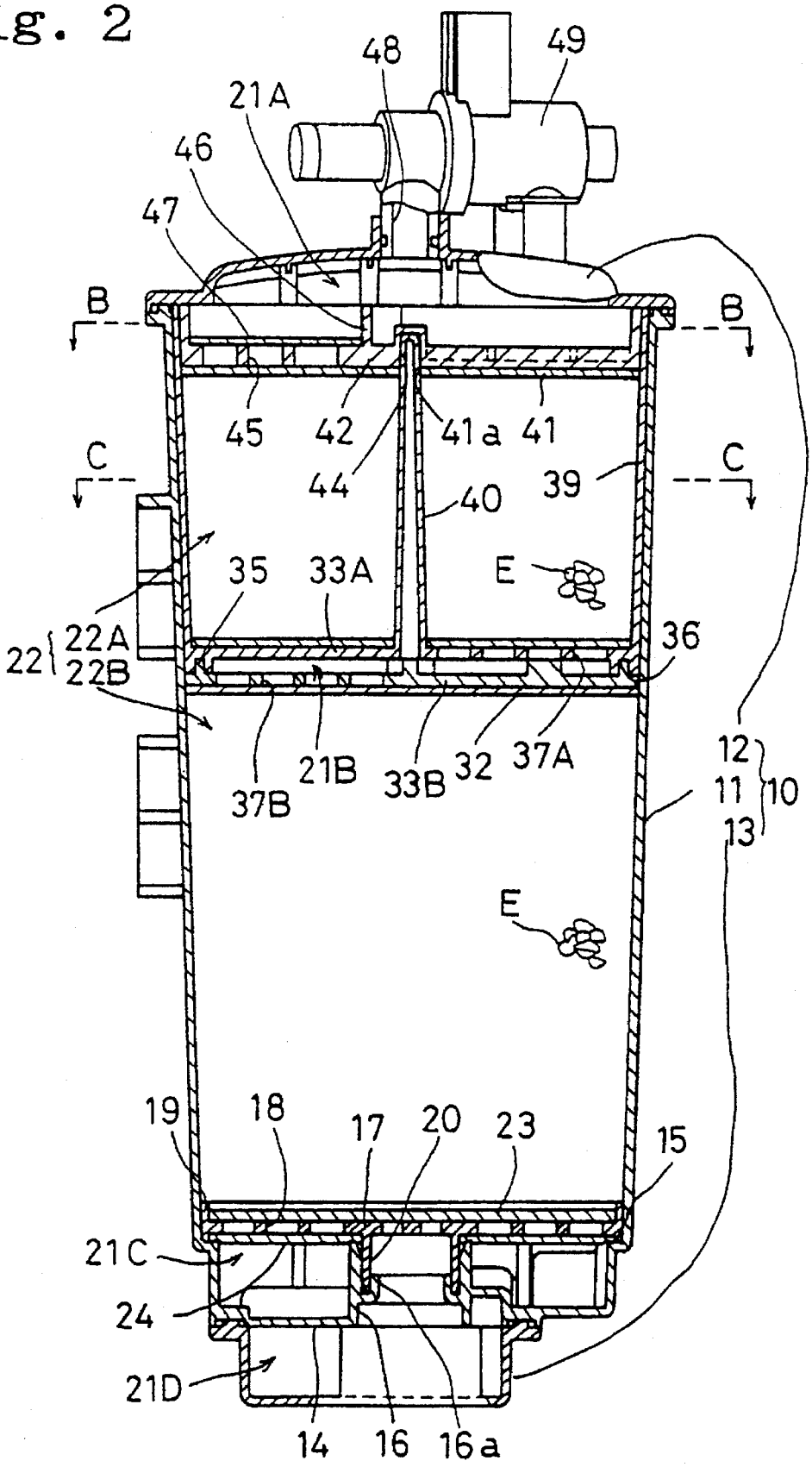
FIG. 2 is a sectional view of the canister taken along line A—A in FIG. 1.
Figure 3:
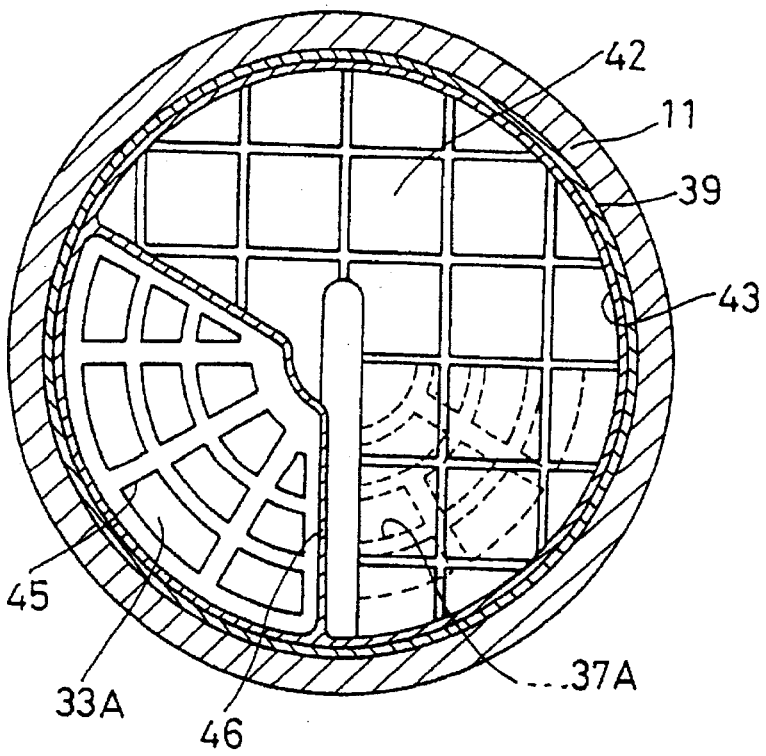
FIG. 3 is a sectional view of the canister taken along line B—B in FIG. 2.
Figure 4:
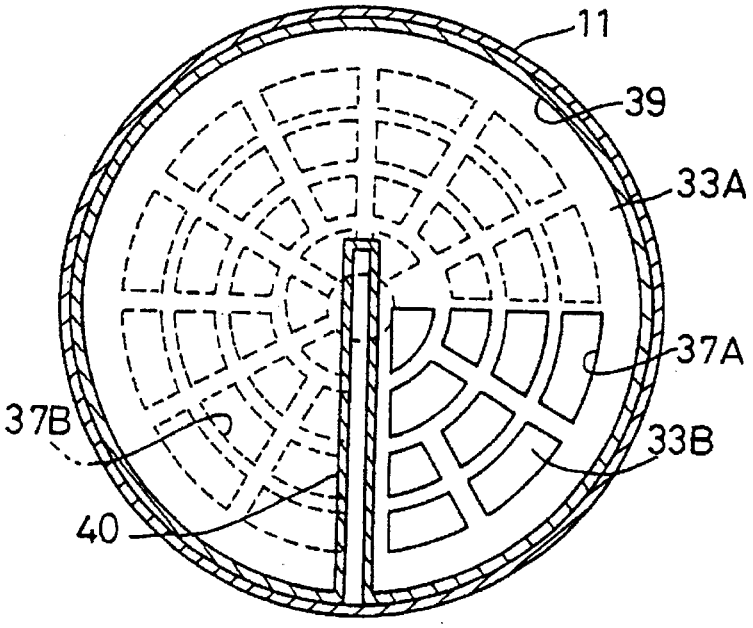
FIG. 4 is a sectional view of the canister taken along line C—C in FIG. 2.
Figure 5:
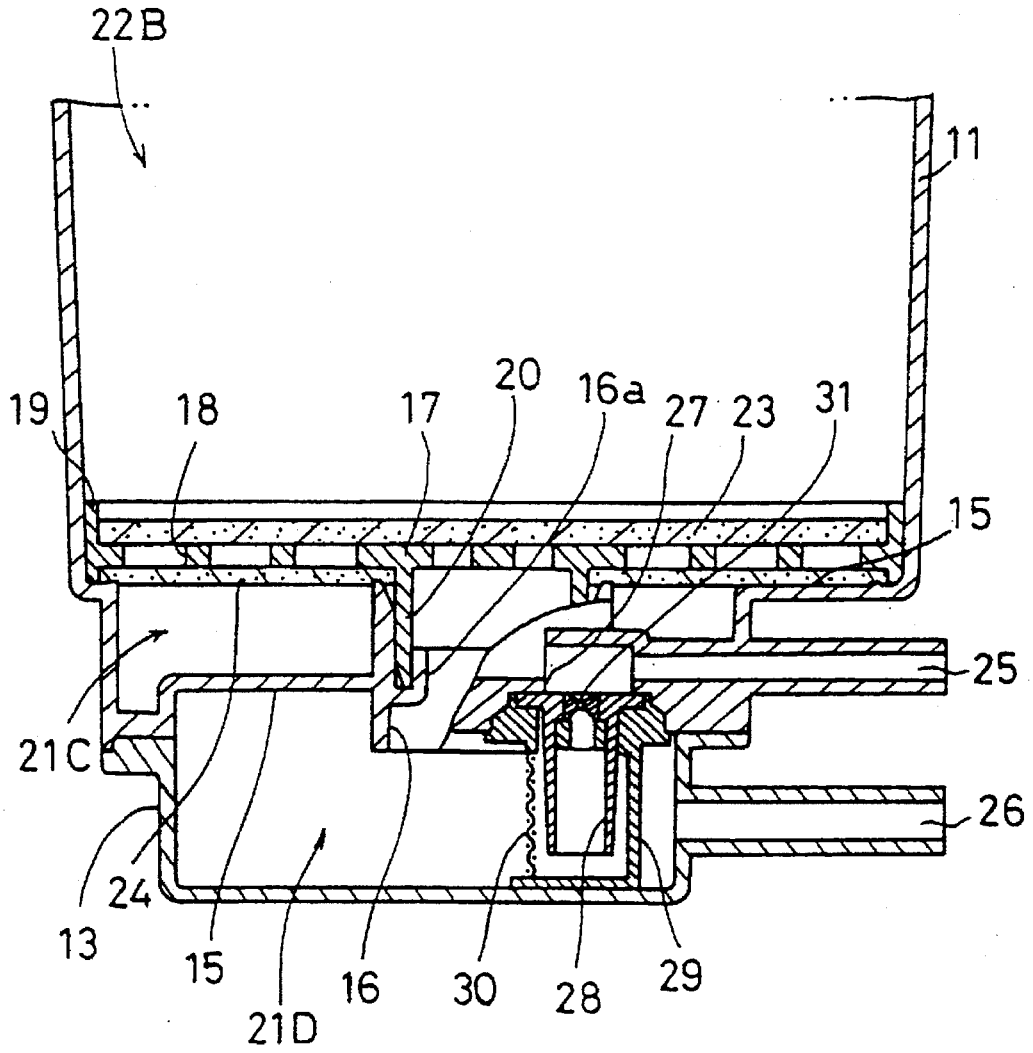
FIG. 5 is a longitudinal sectional view of the lower portion of a casing of the canister.

A first embodiment of the present invention will be described with reference to FIGS. 1 to 6. Referring to FIG. 1, a fuel vapor capturing canister in accordance with the present invention comprises a casing 10 including a bottomed cylindrical body 11, an upper lid 12 and a bottom lid 13. The diameter of the bottom of the casing body 11 is reduced in the vicinity of a bottom plate 14 such that a stepped mounting portion 15 is formed on the inner periphery thereof, as shown in FIG. 5. A cylindrical fuel intake 16 is formed centrally of the bottom plate 14 so as to protrude upwardly and downwardly therefrom. A circular support plate 17 having a plurality of communicating holes 18 is tightly fitted in the casing body 11. The support plate 17 has a short cylindrical rib 19 protruding upwardly and downwardly from the outer circumferential edge thereof. The rib 19 of the support plate 17 is mounted on the mounting portion 15. The support plate 17 further has a cylindrical leg 20 protruding from the central underside thereof. The leg 20 of the support plate 17 is fitted with a cylindrical receiving portion **16*a* formed on the inner circumference of the fuel intake 16, so that the support plate 17 is mounted on the mounting portion 15. The interior of the casing body 11 is divided by the support plate 17 into a lower first bottom air space 21C and an upper activated carbon layer 22** serving as an adsorbent layer.

A circular filter pad 23 having both gas permeability and elasticity is fitted with the rib 19 so as to be mounted on the upside of the support plate 17. An annular filter pad 24 having both gas permeability and elasticity is fitted with the rib 19 and the leg 20. The circumferential edge of the filter pad 24 is mounted on the mounting portion 15 at the underside of the support plate 17.

The casing body 11 has a suction pipe 25 which is formed on the lower side thereof so as to communicate with the first bottom air space 21C and to extend transversely. The suction pipe 25 is to be connected to a fuel intake system (not shown) of an engine. The suction pipe 25 communicates with the activated carbon layer 22 via the first bottom air space 21C, the filter pads 23 and 24, and the communicating hole 18 in sequence.

The dish-shaped bottom lid 13 is airtightly secured to the bottom of the casing body 11 so as to cover the bottom from below. The bottom lid 13 defines therein a second bottom air space 21D. The bottom lid 13 has an exhaust pipe 26 extending transversely from the side thereof and communicating with the second bottom air space 21D. The exhaust pipe 26 is to be connected to a fuel tank (not shown) of an automobile or the like. The exhaust pipe 26 communicates with the activated carbon layer 22 via the second bottom air space 21D, the fuel intake 16, the communicating hole 18, and the filter pad 23 in sequence.

The suction pipe 25 has a mounting hole 27 which is formed in the vicinity of its open end communicating with the first bottom air space 21C and which is open downwardly. A generally cylindrical holder 28 having an orifice 31 therein is fitted into the mounting hole 27 from below, and a bottomed cylindrical retainer 29 is attached to the holder 28 so as to surround and hold the same. A filter 30 is attached to an opening formed in a side of the retainer Thus, the first bottom air space 21C communicates with the second bottom air space 21D via the suction pipe 25, the orifice 31, the holder 28, the retainer 29, and the filter 30 in sequence. A predetermined amount of activated carbon E constituting the activated carbon layer 22 is put into the casing body 11 until it reaches the level slightly higher than the middle of the casing body. A filter pad 32 is placed on the activated carbon E, and a lower partitioning plate 33B is placed on the filter pad 32. Furthermore, an upper partitioning plate 33A serving as a partition is placed on the lower partitioning plate 33B. The filter pad 32 and the upper and lower partitioning plates 33A and 33B have respective circular configurations corresponding to the inner circumference of the casing body 11 and are loosely fitted into the casing body 11. The activated carbon layer 22 is divided by the partitioning plates 33A and 33B into an upper activated carbon layer 22A and a lower activated carbon layer 22B.

A protrusion 35 extending along the upper outer circumferential edge of the lower partitioning plate 33B is fitted into a fitting groove 36 formed along the underside outer circumferential edge of the upper partitioning plate 33A, so that the upper and lower partitioning plates 33A and 33B are assembled together with a small middle air space being defined therebetween. The lower partitioning plate 33B has a plurality of communicating holes 37B formed in a sectorial area which is defined by an arc ranging over three quarters of the circumference of the plate 33B, and the upper partitioning plate 33A has a plurality of communicating holes 37A formed in a sectorial area which is defined by an arc ranging over one fourth of the circumference of the plate 33A, as shown in FIG. 4. The sectorial areas of the upper and lower partitioning plates 33A and 33B are formed so as not to be laid one over the other. The upper partitioning plate 33A has a cylindrical circumferential wall 39 which is formed on the upside thereof along the outer circumferential edge so as to surround the upper activated carbon layer 22A. The circumferential wall 39 is fitted in the casing body 11.

A deflecting plate 40 is formed integrally with the upper partitioning plate 33A into a flat shape, extending longitudinally of the casing 10 in the upper activated carbon layer 22A from the upside of the upper partitioning plate 33A to the underside of a presser plate 42 which will be described later. As shown in FIG. 4, the deflecting plate 40 extends transversely from the circumferential wall 39 toward the center of the same, terminating slightly beyond the center. The deflecting plate 40 is positioned so as to be adjacent to the sectorial area of the upper partitioning plate 33A where the communicating holes 37A are formed. The interior of the casing body 11 defined by the circumferential wall 39 is also filled with the activated carbon E so that the upper activated carbon layer 22A is formed. A filter pad 41 having a notched groove 41*a* is placed on the upper activated carbon layer 22A. The notched groove 41*a* is formed so as to correspond to the deflecting plate 40. The dish-shaped presser plate 42 serving as a partition is further placed on the filter pad 41. The presser plate 42 has a low circumferential wall 43 extending along the outer circumferential edge thereof and a fitting concavity 44 formed in the underside thereof. The upper edge of the deflecting plate 40 is fitted into the fitting concavity 44. The presser plate 42 has a plurality of communicating holes 45 formed in a sectorial area which is defined by an are ranging over one third of the circumference of the plate 42, so that the communicating holes 45 are opposite to the communicating holes 37A of the upper partitioning plate 33A with the deflecting plate 40 being interposed between the plates 33A and 40.

A partition wall 46 continuous from the circumferential wall 39 is formed along the sectorial area of the presser plate 42 where the communicating holes 45 are formed. A filter pad 47 is fitted from above with a sectorial area defined by the circumferential wall 39 and the partition wall 46. The dish-shaped upper lid 12 is airtightly secured to the upper circumferential end of the casing body 11. An upper air space 21A is defined between the presser plate 42 and the upper lid 12. The upper lid 12 has an atmosphere pipe 48 having a small diameter and protruding upwardly from the central portion thereof. An adapter 49 is attached to an external opening of the atmosphere pipe 48 for connection to a hose (not shown). The upper air space 21A communicates with the atmosphere outside the casing 10 via the adapter 49 and the hose.

The operation of the fuel vapor capturing canister will now be described. Fuel in the fuel tank (not shown) is vaporized when the atmospheric temperature rises in the stopped state of the engine. The resultant fuel vapor enters the second bottom air space 21D through the exhaust pipe 26. The fuel vapor further enters the lower activated carbon layer 22B through the fuel intake 16. The fuel vapor flows upwardly in the lower activated carbon layer 22B with the fuel component being adsorbed by the activated carbon E. In this regard, the fuel vapor flows upwardly, diffusing transversely in the activated carbon layer 22B. Reaching the upper end of the lower activated carbon layer 22B, the fuel vapor not adsorbed by the activated carbon E enters the intermediate air space 21B through the communicating holes 37B formed in the sectorial area of the lower partitioning plate 33B which is defined by the arc ranging over three quarters of the circumference thereof. The fuel vapor which has not passed through the communicating holes 37B strikes against the lower partitioning plate 33B and is thereby diffused downwardly in the lower activated carbon layer 22B, so that the fuel vapor is adsorbed by the activated carbon E.

The fuel vapor having entered the intermediate air space 21B flows horizontally to the communicating holes 37A formed in the sectorial area of the upper partitioning plate 33A which is defined by the arc ranging over one quarter of the circumference thereof. The fuel vapor then enters the upper activated carbon layer 22A through the communicating holes 37A. Since the fuel vapor is caused to flow horizontally in the intermediate air space 21B, it is sufficiently diffused.

The fuel vapor spirals in the upper activated carbon layer 22A, bypassing the deflecting plate 40, as shown by arrow P in FIG. 1. Thus, the fuel vapor flows toward the communicating holes 45 formed in the sectorial area which is defined by the arc ranging over one third of the circumference of the presser plate 42. In this while, almost all the fuel vapor is adsorbed into the activated carbon layer E of the upper layer 22A. The fuel vapor not having been adsorbed by the activated carbon E reaches the upper end of the upper activated carbon layer 22A, being repelled downwardly by the presser plate 42 to be thereby adsorbed by the activated carbon E.

According to the above-described embodiment, the fuel vapor does not rise linearly but spirals when passing through the upper activated carbon layer 22A. Accordingly, the path of the fuel vapor passing through the upper activated carbon layer 22A can be rendered longer, and the path spreads over the entire upper activated carbon layer 22A. Consequently, since a total amount of activated carbon E coming into contact with the fuel vapor is increased, a high fuel vapor adsorbing efficiency can be achieved. Furthermore, since a ratio of the upper activated carbon layer 22A to the lower activated carbon layer 22B can be changed readily, the fuel vapor adsorbing efficiency can be regulated easily.

Upon start of the engine, the negative pressure is produced in the intake system. The negative pressure is supplied to the suction pipe 25 of the casing 10 of the canister. Since only the atmosphere pipe 48 of the casing 10 communicates with the atmosphere, the air is drawn through the hose, the adapter 49, and the atmosphere pipe 48 in sequence into the upper air space 21A. The air then passes through the communicating holes 45 of the presser plate 42, the upper activated carbon layer 22A, the communicating holes 37A of the upper partitioning plate 33A, the intermediate air space 21B, the communicating holes 37B of the lower partitioning plate 33B, the lower activated carbon layer 22B, the communicating holes 18 of the support plate 17, and the first bottom air space 21C in sequence, supplied to the suction system through the suction pipe 25. Since air having a low fuel concentration passes through the upper and lower activated carbon layers 22A and 22B while the air is being drawn, the fuel component captured by the activated carbon E is evaporated by the air to be purged from the same, whereupon dense fuel vapor is supplied to the suction system. In this regard, the air spirals in the direction opposite to arrow P in the upper activated carbon layer 22A. Accordingly, the air flow path is rendered longer than in the case where the air flows linearly downwardly, and the air flow path spreads over the entire upper activated carbon layer 22A. Consequently, a high fuel component evaporating efficiency can be achieved.

Figure 6:
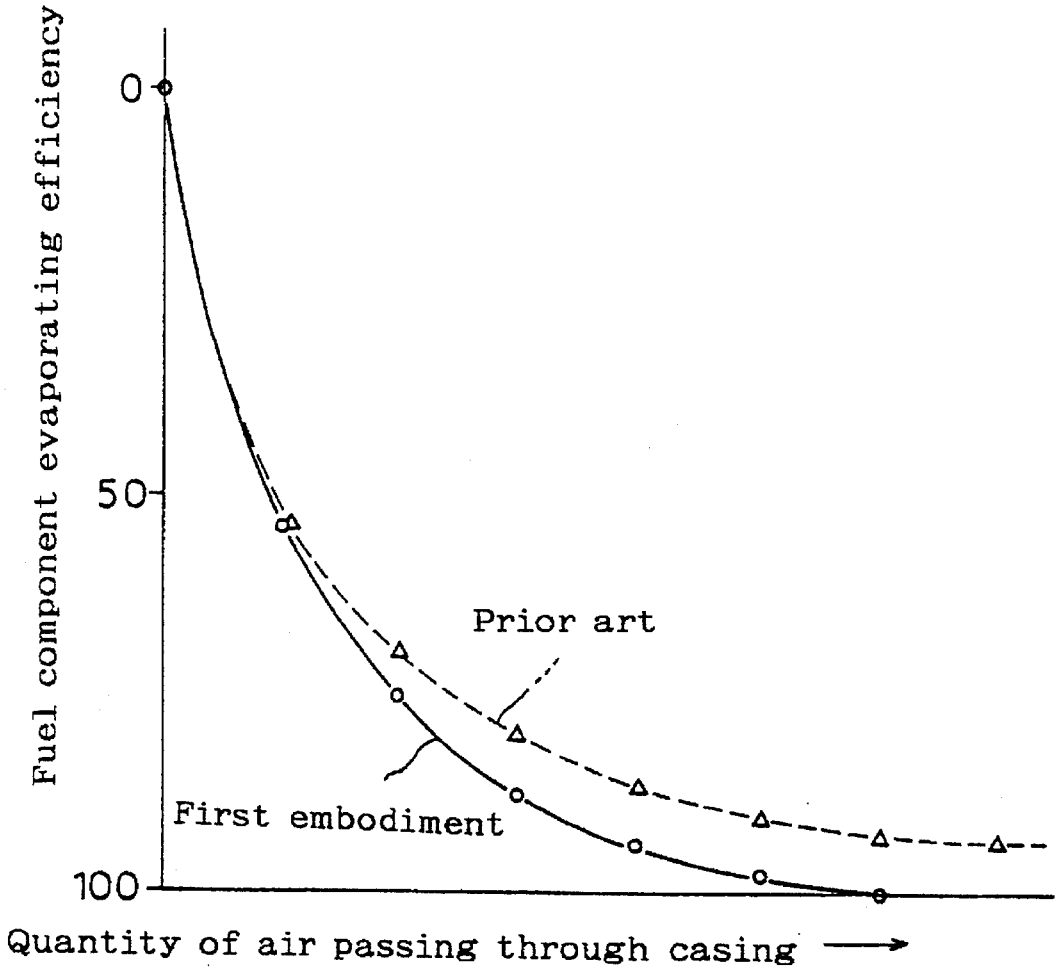
FIG. 6 is a graph showing the relations between the quantity of air flowing through the casing and the fuel component evaporating efficiency in the casing in the comparison between the first embodiment of the present invention and the prior art.

FIG. 6 shows the relations between the quantity of air flowing through the casing and the fuel component evaporating efficiency in the canister casing in the comparison between the first embodiment of the present invention and the prior art. As obvious from the graph of FIG. 6, the fuel component evaporating efficiency is improved in the canister of the first embodiment as compared with the prior art canister when the same amount of air is drawn.

A part of the fuel vapor which has been purged from the activated carbon E does not pass through the communicating holes 37A of the upper partitioning plate 33A or the communicating holes 18 of the support plate 17. Such fuel vapor is returned into the upper activated carbon layer 22A or the intermediate activated carbon layer 22B. However, the fuel vapor can be drawn into the suction system while an air flow is present in either activated carbon layer.

A part of the fuel vapor produced from the fuel tank upon start of the engine and entering the second bottom air space 21D does not flow to the fuel intake 16 but is sucked to the orifice 31 due to the negative pressure in the suction pipe 25. The fuel vapor is atomized when passing through the orifice 31. The atomized fuel vapor is sucked to the suction system through the suction pipe 25.

The fuel in the liquid form sometimes collects on the bottom of the second bottom air space 21D upon start of the engine. In this case, too, the liquid fuel evaporates and passes through the orifice 31 such that the atomized fuel is sucked to the side of the suction system through the suction pipe 25. Since the fuel passes through the orifice 31, the quantity of fuel sucked to the side of the suction system as described above is slight. Accordingly, the fuel supplied to the engine is prevented from being abnormally concentrated, and the fuel concentration is prevented from being varied. Consequently, stable operation of the engine can be ensured.

The deflecting plate 40 is formed into a simple flat configuration in the above-described embodiment. The deflecting plate 40 is thus advantageous in cost and the assembly thereof to the casing is rendered easy as compared with the case in which plate members each having a complicate configuration are employed to provide the same flow path as described above.

Figure 7:
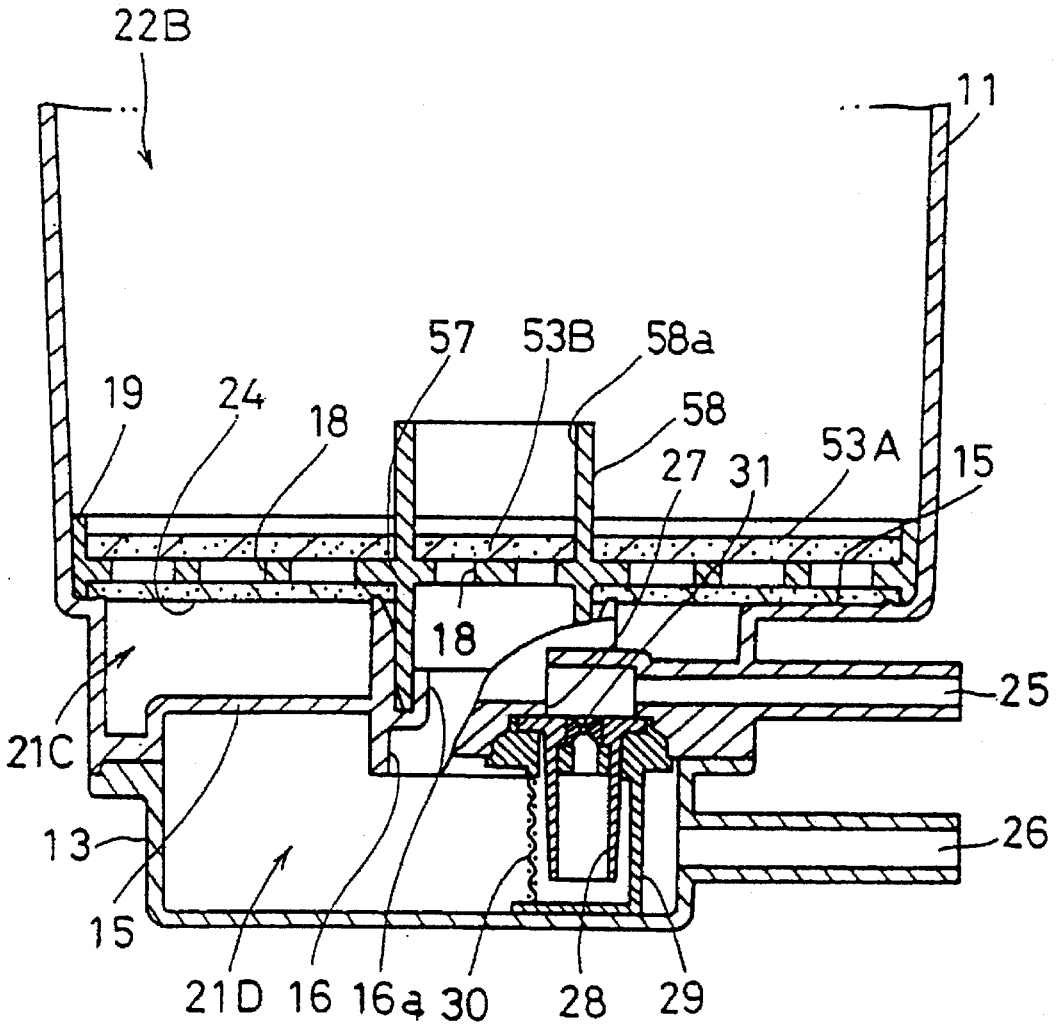
FIG. 7 is a longitudinal sectional view of the lower portion of a canister of a second embodiment in accordance with the present invention.

Furthermore, it is difficult to perfectly fill the casing with the activated carbon when the deflecting plate has a complicate configuration and is disposed crosswise with respect to the length of the canister casing. In the above-described embodiment, however, the deflecting plate 40 has a simple configuration and is disposed longitudinally of the casing 10. Consequently, the casing 10 can be filled with the activated carbon E without any vacant space left in the activated carbon layer 22. Thus, the interior of the casing 10 can be used for the adsorption of fuel vapor efficiently. FIG. 7 illustrates a second embodiment of the present invention. The second embodiment differs in the configuration of the support plate from the first embodiment. The parts identical with those in the first embodiment are labeled by the same reference numerals in the second embodiment.

The support plate 57 has a cylindrical protrusion 58 formed on the upside thereof. The protrusion 58 is concentric with the fuel intake 16 disposed below the support plate 57 and has an outer diameter same as the inner diameter of the fuel intake 16. The protrusion 58 communicates with the fuel intake 16 via the communicating holes 18. An annular filter pad 53A is fitted with the rib 19, and a circular filter pad 53B is fitted in the protrusion 58.

Entering the second bottom air space 21D, the fuel vapor produced at the fuel tank flows upwardly through the fuel intake 16, the communicating holes 18, the filter pad 53B, and the protrusion 58 in sequence. The fuel vapor then enters the lower activated carbon layer 22B through an upper end opening **58*a* of the protrusion 58. The fuel vapor flows upwardly in the activated carbon layer 22B, diffusing transversely in the same. Accordingly, the fuel vapor would reach the lower partitioning plate 33B without sufficient transverse diffusion when the protrusion 58** is not low enough.

Figure 10:
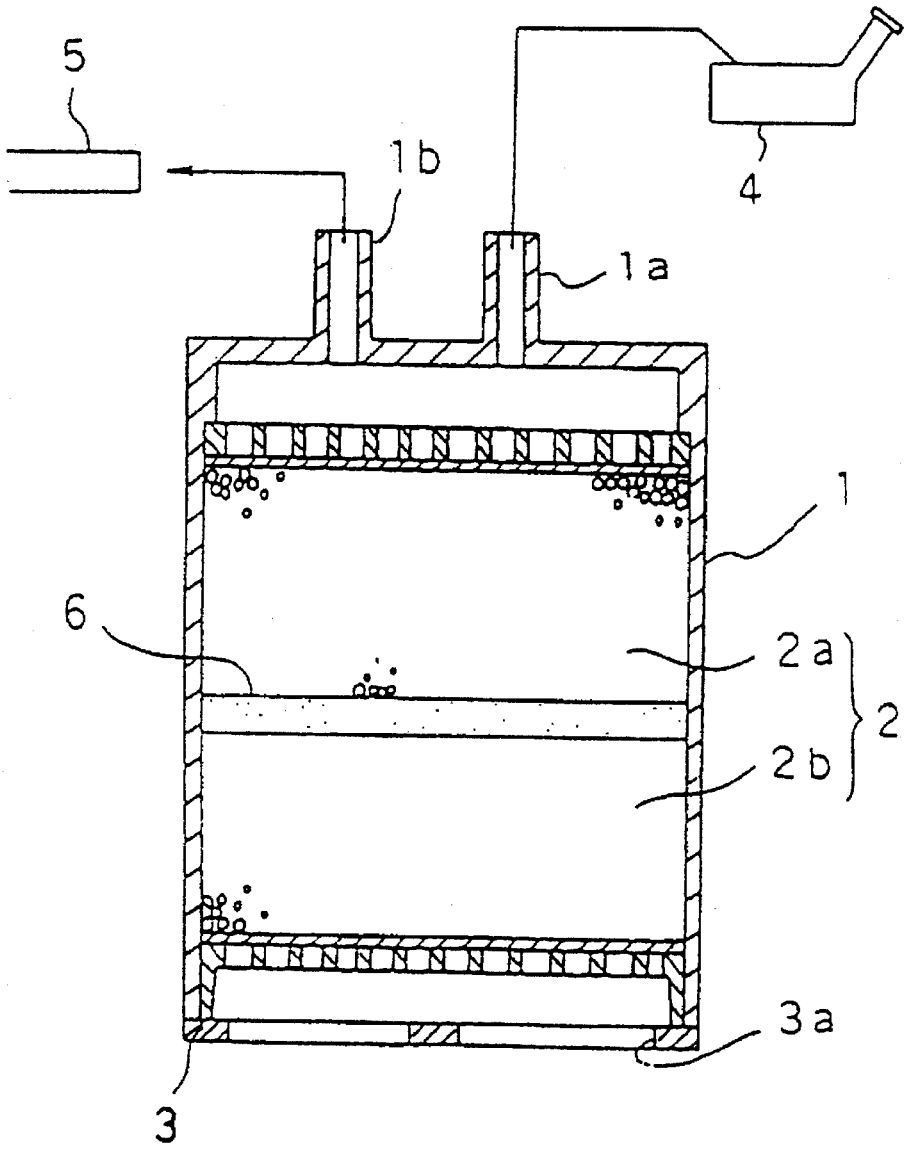
FIG. 10 is a longitudinal sectional view of a prior art canister.

Without the protrusion 58, the fuel vapor having entered the casing 1 through the opening **1*a* would sometimes flow into the intake pipe 5 without flowing through the activated carbon layer 2*a* as in the case of the prior art canister shown in FIG. 10**. In such a case, the variations of the fuel concentration would result in unstable operation of the engine.

In the second embodiment, however, the support plate 57 is formed with the protrusion 58 protruding upwardly therefrom, and the protrusion 58 has the opening **58*a* which is located higher than the support plate 57 and through which the fuel vapor enters the lower activated carbon layer 22B. As the result of provision of the protrusion 57, the fuel vapor produced at the fuel tank enters the lower activated carbon layer 22B through the opening 58*a* and passes through the activated carbon layer extending to the upside of the support plate 57**. The fuel vapor is then supplied to the suction system of the engine. Consequently, the operation of the engine can be stabilized.

Figure 8:
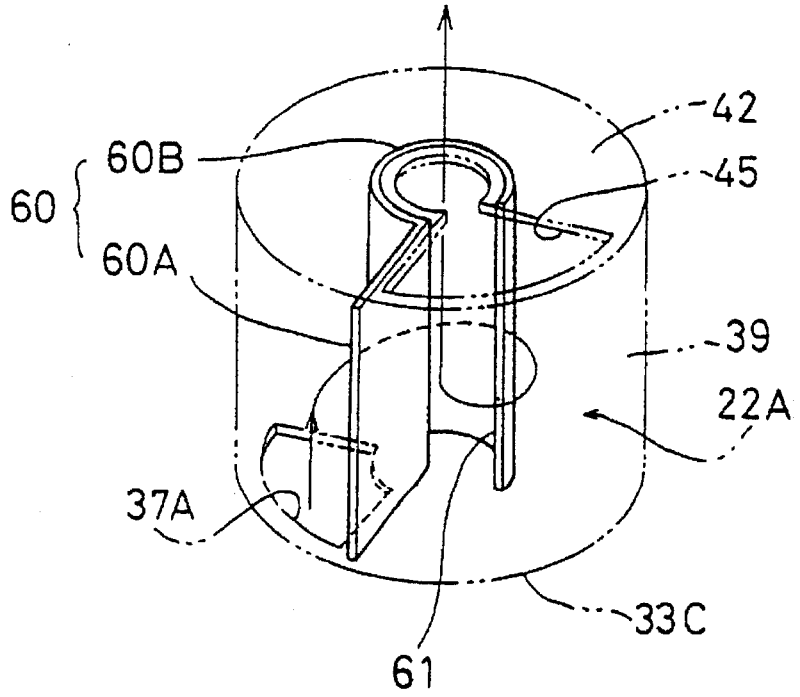
FIG. 8 is a schematic perspective view of a deflecting plate employed in a canister of a third embodiment in accordance with the present invention.

FIG. 8 illustrates a third embodiment of the present invention. The third embodiment differs in the configuration of the deflecting plate from the first embodiment. The parts identical with those in the first embodiment are labeled by the same reference numerals in the third embodiment.

The deflecting plate 60 employed in the third embodiment includes a flat portion 60A extending linearly from the inner circumference of the circumferential wall 39 of the upper partitioning plate 33A toward the center of the same and an arc portion 60B concentric with the upper partitioning plate 33A and having an arc ranging over 270 degrees. The flat portion 60A is continuous at a central end thereof to one end of the arc portion 60B such that the deflecting plate 60 is generally formed into the shape of a question mark.

The communicating holes 37A are formed in a sectorial area of the upper partitioning plate 33A which is defined by an arc ranging over one quarter of the circumference of the same and which is adjacent to the flat portion 60A, so that the holes 37A are located opposite to an opening 61 of the are portion 60B with the flat portion 60A positioned therebetween. On the other hand, the communicating holes 45 are formed in a sectorial area of the presser plate 42 which is defined by an arc ranging over one quarter of the circumference of the same and which is symmetric with the sectorial area of the communicating holes 37A about the flat portion 60A. The communicating holes 45 are further formed in a circular area of the presser plate 42 corresponding to the arc portion 60B.

Entering the upper activated carbon layer 22A through the communicating holes 37A of the upper partitioning plate 33A, the fuel vapor spirals along a side wall surface of the flat portion 60A and along an outer circumferential surface of the arc portion 60B. Thus passing through the upper activated carbon layer 22A, the fuel vapor reaches the communicating holes 45 of the presser plate 42. The air drawn from the atmosphere spirals along the above-described path in the opposite direction, passing through the upper activated carbon layer 22A.

In the third embodiment, too, the path of the fuel vapor passing through the upper activated carbon layer 22A can be rendered longer as in the first embodiment. Consequently, a high fuel vapor adsorbing efficiency and a high fuel component evaporating efficiency can be achieved. Furthermore, the deflecting plate 60 has a simple configuration and is disposed longitudinally of the casing 10. Consequently, since the casing 10 can be filled with the activated carbon E without any vacant space left in the activated carbon layer 22, the interior of the casing 10 can be used for the adsorption of fuel vapor efficiently.

Figure 9:
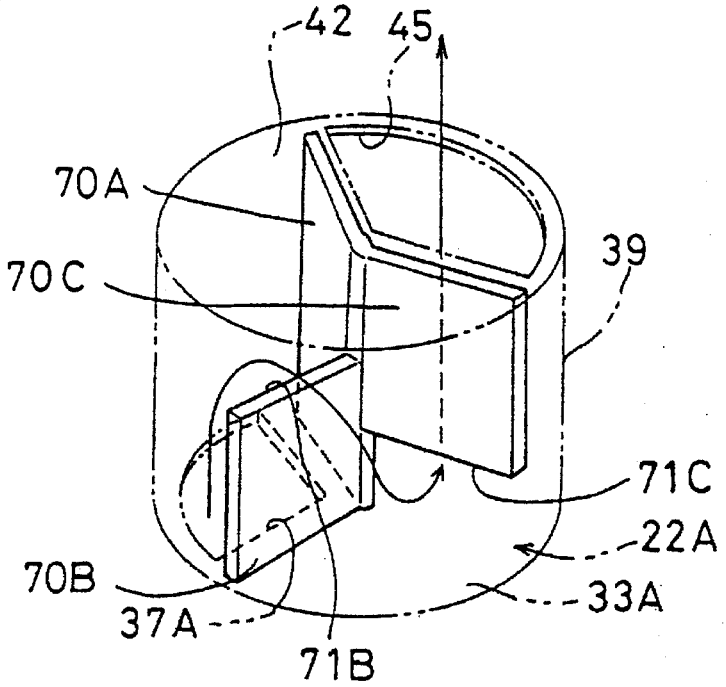
FIG. 9 is a schematic perspective view of deflecting plates employed in a canister of a fourth embodiment in accordance with the present invention.

FIG. 9 illustrates a fourth embodiment of the present invention. The fourth embodiment differs in the construction of the deflecting plate from the first embodiment. The parts identical with those in the first embodiment are labeled by the same reference numerals in the fourth embodiment.

Three flat deflecting plates 70A, 70B and 70C extend from the circumferential wall 39 of the upper partitioning plate 33A to the center of the same at equal intervals of 120 degrees. The deflecting plates 70A, 70B and 70C are connected together at the center of the upper partitioning plate 33A. The first deflecting plate 70A serving as the deflecting plate constituting the present invention extends from the upper partitioning plate 33A to the presser plate 42. Spaces partitioned by the first deflecting plate 70A are airtightly isolated from each other. The second deflecting plate 70B serving as an auxiliary deflecting plate rises from the upper surface of the upper partitioning plate 33A, and an upper one third of the plate 70B is cut off such that an upper opening 71B is defined. An upper end of the third deflecting plate 70C serving as an auxiliary deflecting plate abuts against the presser plate 42, and a lower one third of the plate 70C is cut off such that a lower opening 71C is defined. The communicating holes 37A are formed in a sectorial area of the upper partitioning plate 33A which is defined by an arc ranging over one third of the circumference thereof between the first and second deflecting plates 70A and 70B. The communicating holes 45 are formed in a sectorial area which defined by an arc ranging over one third of the circumference of the same between the first and third deflecting plates 70A and 70C.

Entering the upper activated carbon layer 22A through the communicating holes 37A of the upper partitioning plate 83A, the fuel vapor rises upwardly in the space between the first and second deflecting plates 70A and 70B and then flows obliquely toward the second deflecting plate 70B. The fuel vapor flows over the second deflecting plate 70B, passing though the upper opening 71B. The fuel vapor then enters the space between the second and third deflecting plates 70B and 70C, descending in the space and flowing obliquely toward the third deflecting plate 70C. The fuel vapor then enters the space between the first and third deflecting plates 70A and 70C through the lower opening 71C. The fuel vapor again rises in the space, entering the communicating holes 45 of the presser plate 42. Thus, the fuel vapor rises and descends in the upper activated carbon layer 22A, making a substantial round of the layer 22A. Furthermore, the air drawn from the atmosphere flows along the above-described path in the opposite direction, passing through the upper activated carbon layer 22A.

In the fourth embodiment, too, the path of the fuel vapor passing through the upper activated carbon layer 22A can be rendered longer as in the first embodiment. Consequently, a high fuel vapor adsorbing efficiency and a high fuel component evaporating efficiency can be achieved. Furthermore, each of the deflecting plates 70A, 70B and 70C has a simple configuration and is disposed longitudinally of the casing 10. Consequently, since the casing 10 can be filled with the activated carbon E without any vacant space left in the activated carbon layer 22, the interior of the casing 10 can be used for the adsorption of fuel vapor efficiently.

Although a number of communicating holes 37A are formed in the upper partitioning plate 33A in the foregoing embodiments, the plate 33A may have one or a reduced number of communicating holes 37A, instead. When the number of the communicating holes 37A is thus reduced, the flow paths of the fuel vapor flowing from the intermediate air space 21B into the upper activated carbon layer 22A are converged to the communicating hole or holes 37A. Accordingly, the fuel vapor having passed through the communicating hole or holes 37A tends to be diffused horizontally in the upper activated carbon layer 22A more readily, whereupon the fuel vapor adsorbing efficiency can be further improved.

When the number of the communicating holes 37B of the lower partitioning plate 33B is reduced in the same way, the flow paths of the air flowing from the intermediate air space 21B into the lower activated carbon layer 22B are converged to the communicating hole or holes 37B. Accordingly, the air having passed through the communicating hole or holes 37B tends to be diffused horizontally in the lower activated carbon layer 22B more readily, which can improve the efficiency in the evaporating of the fuel component captured by the activated carbon E of the lower activated carbon layer 22B.

The activated carbon layer 22 accommodated in the casing 10 is divided into the two layers 22A and 22B, and the deflecting plate is provided only in the upper layer 22A in the foregoing embodiments. Two such deflecting plates may be provided in the respective activated carbon layers, instead.

The partitioning plates 33A and 33B are provided in the activated carbon layer 22 to divide the same into the upper and lower layers 22A and 22B in the foregoing embodiments. The activated carbon layer 22 may be divided into three or more layers, instead. The activated carbon layer in which the deflecting plate is provided may be optionally selected.

Furthermore, the activated carbon layer 22 is divided by the partitioning plates 33A and 33B into the upper and lower layers 22A and 22B in the foregoing embodiments. A single activated carbon layer may be provided in the casing 10 without use of the partitioning plates, and the deflecting plate may be provided in the single activated carbon layer, instead.

The foregoing description and drawings are merely illustrative of the principles of the present invention and are not to be construed in a limiting sense. Various changes and modifications will become apparent to those of ordinary skill in the art. All such changes and modifications are seen to fail within the true spirit and scope of the invention as defined by the appended claims.

We claim:

1. A fuel vapor capturing canister comprising:

a hollow cylindrical casing closed at opposite ends and having a first opening at one end for communication with the atmosphere and a second opening at the other end for selective communication with a fuel storage system and an intake system of an engine;

an adsorbent material disposed in the casing to form at least one layer therein;

transversely extending plate means disposed at longitudinally spaced locations along the casing to define the ends of said at least one layer of adsorbent material;

a fluid impervious deflecting plate extending longitudinally of said casing between said transversely extending plate means and protruding at one edge from a casing wall to a position spacing the opposite edge of the deflecting plate from said casing wall adjacent thereto; and communicating holes formed in said transversely extending plate means for effecting a flow of fluid generally longitudinally through said casing between said first and second openings therein, said communicating holes being disposed in a plate forming one of said transversely extending plate means on one side of said deflecting plate and in another plate defining said transversely extending plate means on the opposite side of said deflecting plate wherein fluid flowing through said layer of adsorbent material has a transverse component of direction imposed thereon by said deflecting plate.

2. A fuel vapor capturing canister according to claim 1 further including an auxiliary deflecting plate disposed in angular displaced relation with respect to said deflective plate whereby said auxiliary deflecting plate extends longitudinally of said casing and protrudes from the casing wall into abutting relation with an intermediate portion of said deflecting plate; and means forming openings in said deflection plate and said auxiliary deflection plate to impart a circuitous direction of flow in the fluid flowing through said layer of adsorbent material between said plates of said traversely extending plate means.

3. A fuel vapor capturing canister according to claim 1 or claim 2, wherein a layer disposed between the transversely extending plates is a part of the adsorbent material disposed in the casing.

4. A fuel capturing canister according to any one of claims 1 or claim 2, wherein one of the transversely extending plate means comprises parallelly disposed plate members juxtaposed so that a space is defined therebetween, and sets of openings formed in the plate members with the sets of openings in the respective plates being transversely spaced with respect to each other.

5. A fuel vapor capturing canister according to claim 3, wherein one of the transversely extending plate means comprises parallelly disposed plate members juxtaposed so that a space is defined therebetween, and sets of openings formed in the plate members with the sets of openings in the respective plates being transversely spaced with respect to each other.

* * * * *